United States Patent [19]

Deroche et al.

[11] Patent Number: 4,726,212

[45] Date of Patent: Feb. 23, 1988

[54] MACHINE FOR STRAIGHTENING AND STRESS-RELIEVING STEEL RAILS

[75] Inventors: Raymond Y. Deroche, Thionville; Jacques Michaux, Joeuf, both of France

[73] Assignee: Unimetal, Metz, France

[21] Appl. No.: 836,148

[22] Filed: Mar. 4, 1986

[30] Foreign Application Priority Data

Mar. 11, 1985 [FR] France ..... 85 03641

[51] Int. Cl.[4] ..... B21D 25/00

[52] U.S. Cl. ..... 72/302

[58] Field of Search ..... 72/302, 301, 295–297, 72/293, 305

[56] References Cited

U.S. PATENT DOCUMENTS

| | | | |
|---|---|---|---|
| 2,352,442 | 6/1944 | Loewy et al. | 72/302 |
| 2,441,707 | 5/1948 | Lermont | 72/297 |
| 2,446,089 | 7/1948 | Hochreiter | 72/297 |
| 2,487,973 | 11/1945 | Kent . | |
| 2,553,092 | 5/1951 | Hubbert | 72/297 |
| 2,850,071 | 9/1958 | Kraybill | 72/297 |
| 2,908,316 | 10/1959 | Albers . | |
| 3,257,832 | 6/1966 | Harvey . | |
| 3,757,557 | 9/1973 | Kost | 72/302 |
| 4,048,826 | 9/1977 | Lechner et al. | 72/139 |
| 4,141,679 | 2/1979 | Asano et al. . | |
| 4,324,125 | 4/1982 | Jarman et al. | 72/705 |

FOREIGN PATENT DOCUMENTS

| | | | |
|---|---|---|---|
| 21434 | 5/1883 | Fed. Rep. of Germany | 72/302 |
| 962832 | 6/1950 | France . | |
| 1314482 | 12/1962 | France . | |
| 2010865 | 5/1969 | France . | |
| 2132757 | 11/1972 | France . | |
| 2157792 | 6/1973 | France . | |
| 895899 | 5/1962 | United Kingdom . | |
| 408685 | 11/1973 | U.S.S.R. | 72/302 |

*Primary Examiner*—Daniel C. Crane

*Attorney, Agent, or Firm*—Bacon & Thomas

[57] ABSTRACT

A hydraulic stretching machine for straightening and stress-relieving rails, the machine being defined by stretching grips and fixing shackles being displaceable individually and independently, laterally and vertically, with respect to the longitudinal axis of the stretching machine, and grip-holding jaws which can be oriented about a longitudinal axis, the jaws including a fixed jaw and a mobile jaw articulated in and upon the fixed jaw.

4 Claims, 10 Drawing Figures

MACHINE FOR STRAIGHTENING AND STRESS-RELIEVING STEEL RAILS

FIELD OF THE INVENTION

The invention concerns a hydraulic stretching machine for straightening and stress-relieving shaped-section rolled products, such as steel rails for railways or bridge-cranes, either grooved or other similar rails, as well as other shaped-section products such as girders, angle-irons, U-beams and sectional irons for caterpillar tracks, etc.

DESCRIPTION OF THE PRIOR ART

Hydraulic stretching machines for straightening, and sometimes for untwisting, extruded section products in non-ferrous metals are disclosed in the patents BF No. 962,832, BF No. 1,314,482, U.S. Pat. Nos. 2,487,973, 2,908,316, 3,257,832, BF No. 2,132,757, and U.S. Pat. No. 4,141,679.

No machine is known which has been specially designed for straightening rails. A machine for straightening rails by stretching, designed on the basis of state-of-the-art machines, would have the disadvantage of irreparably damaging the structure of the rails before the stretch-straightening operation. Indeed, such a machine would have stretching grips and fixing shackles capable of only a longitudinal displacement along the machine axis. The extremities of the rails to be stretch-straightened would have to be inserted by force into the holding jaws. Knowing that as-cooled rails can have undergone a deformation such that their shape can be inscribed in a rectangle whose maximum width is 2 meters, with a maximum angle of $\pm 8.5°$, it is easy to imagine the stresses to which they would be subjected if they were handled in such a way as to force their extremities into the jaws of the stretching grips and fixing shackles, capable only of a longitudinal displacement. Furthermore, during stretching, additional stresses would arise due to the torque exerted by the fixed grips and jaws.

SUMMARY OF THE INVENTION

The aim of the invention is to avoid subjecting the rails to be straightened to the stresses and disadvantages described above.

To this effect, the subject of the invention is a hydraulic stretching machine for straightening and stress-relieving rails, comprising stretching grips and fixing shackles linked by a ball joint to the shafts of hydraulic stretching and length-adjustment pistons, the stretching grips and fixing shackles being displaceable individually and independently, laterally and vertically, with respect to the longitudinal axis of the stretching machine, and grip-holding jaws which can be oriented about a longitudinal axis, the jaws including a fixed jaw and a mobile jaw articulated in and upon the fixed jaw.

BRIEF DESCRIPTION OF THE DRAWINGS

A preferred embodiment of the invention is described below with reference to the appended drawings in which.

DETAILED DESCRIPTION OF THE PREFERRED EMBODIMENT

Figure 1:
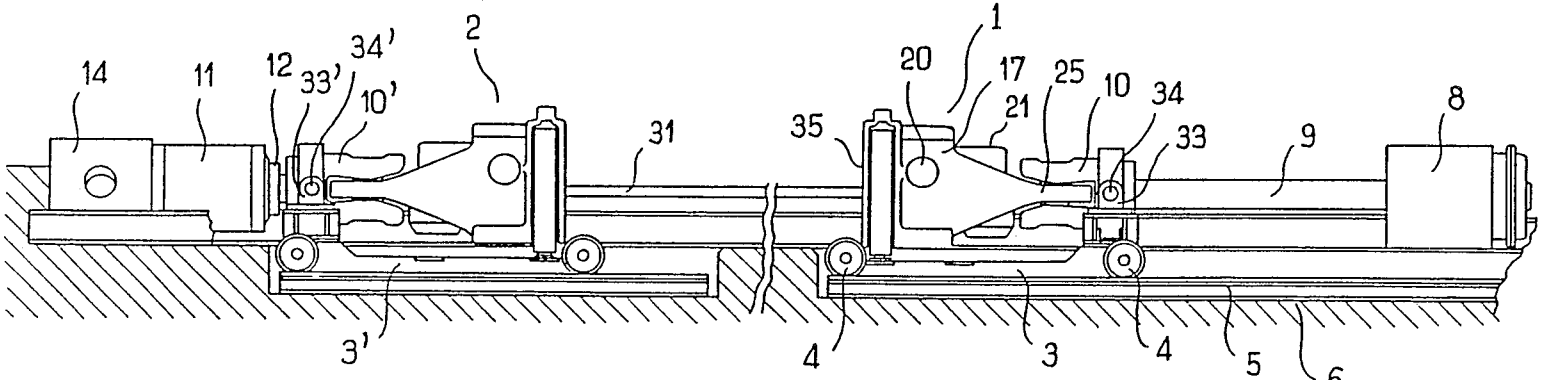
FIG. 1 is a lateral elevation of a machine according to the invention.
Figure 2:
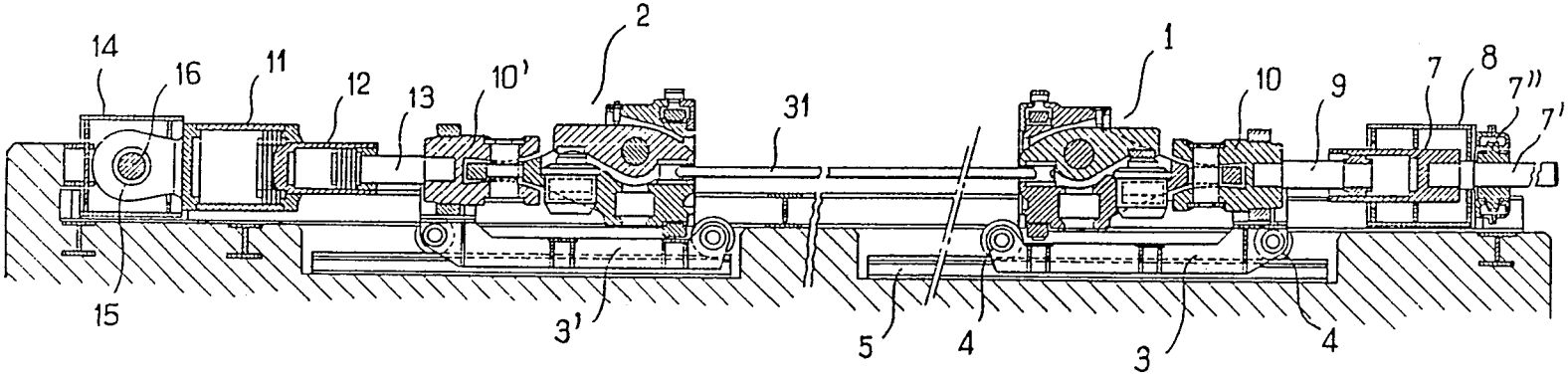
FIG. 2 is a longitudinal section of the machine shown in FIG. 1.

The machine, according to a preferred embodiment of the invention shown in FIGS. 1 and 2, comprises a fixing shackle 1, as well as a stretching grip 2.

The two heads are symmetrically identical. Therefore, for the parts which are in common, the description will be limited to the fixing head, but is equally valid for the stretching head. The two heads can be displaced longitudinally, on carriages 3 and 3', respectively. The carriages 3 and 3' are identical. They are equipped with wheels 4, with one drive-axle and can run on the longitudinal rails 5. The fixing and stretching heads are linked to one another by a frame or bed 6 which absorbs the tensile forces and which rests on the foundations 6 (to simplify the representation, both the frame or bed and the foundations are designated by the reference 6).

The fixing head 1, which can be displaced horizontally, serves to set the machine to the length of the shaped bar to be straightened. The stretching head 2 serves to stretch the shaped bar. An additional function of each head is to grip one extremity of the shaped bar. The displacement of the fixed head 1 is ensured by the piston 7 fixed to a crosshead 8, integrally joined to the frame 6. The shaft 9 of the piston 7 has a fork 10 at its free end. The displacement of the stretching head 2 is ensured by a stretching piston 11 and an auxiliary piston 12. The free end of the shaft 13 of the auxiliary piston 12 comprises a fork 10'. The forks 10 and 10' are identical. They serve to attach the pistons 7, 11 and 12 to the heads 1 and 2, respectively. The forks 10 and 10' are attached to the carriages 3 and 3' by means of both cradles 33 and 33', fixed respectively to the rear ends of the carriages 3 and 3', and also of the horizontal transverse axles 34 and 34' which swivel in the cradles 33 and 33'.

The piston 7 is attached at its free end to a threaded shaft 7'. The shaft 7' can be moved longitudinally by a motorized screw 7''.

The piston 11 is fastened to the frame 6 by means of a crosshead 14, a tie 15, and an axle 16. A feed table, a retractable central table and a discharge table (not shown) are located between the heads 1 and 2, and used for laterally feeding and discharging the shaped bars.

Figure 3:
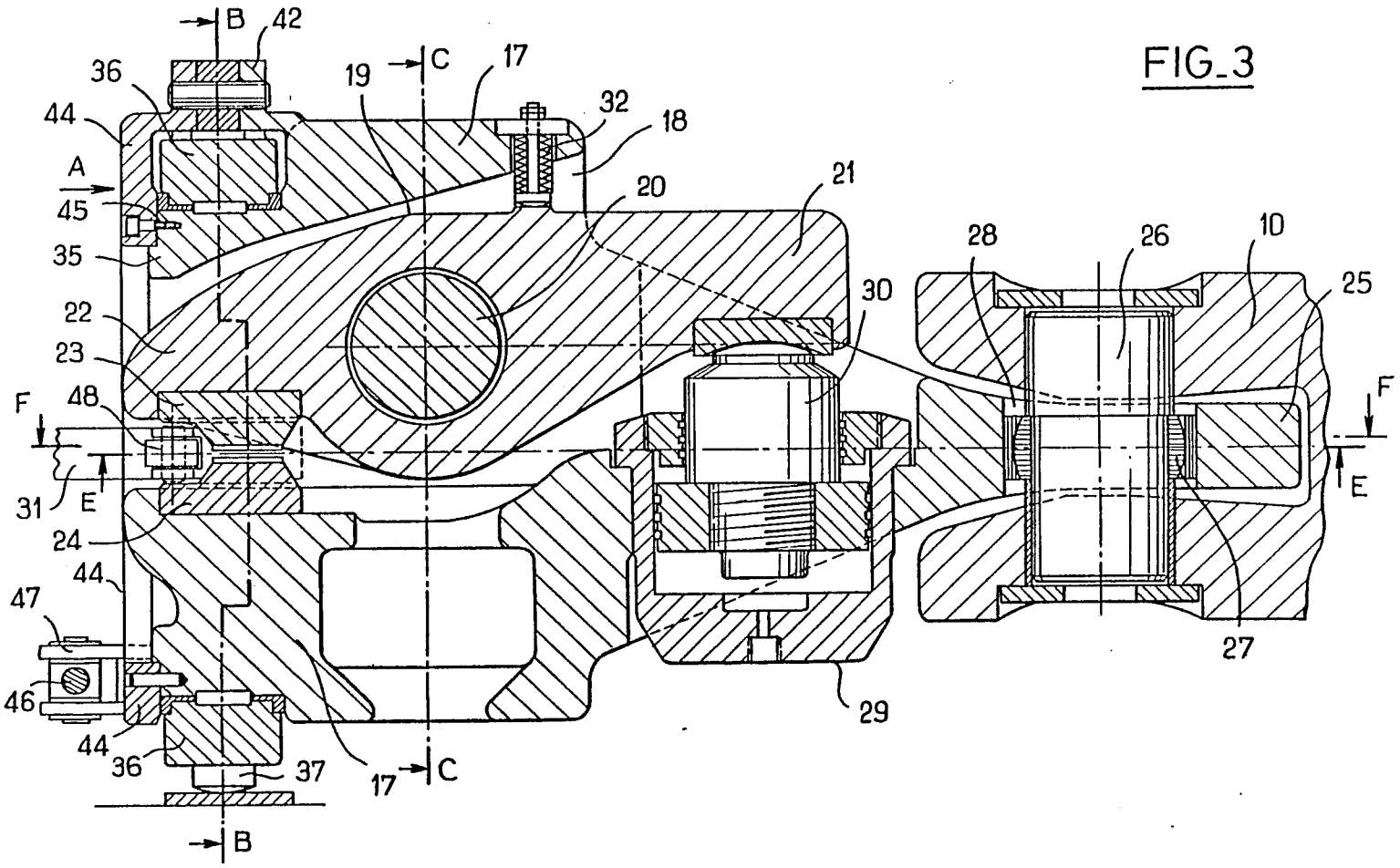
FIG. 3 is an enlargement of part of FIG. 2, showing part of the fixed head.

The fixing head 1 or stretching head 2 shown in FIGS. 1 and 3 comprises a massive body which serves as a fixed jaw 17, in the form of a cylindrical frustum, with walls of variable thickness depending on the forces to be supported and the elements to be attached to it.

Figure 6:
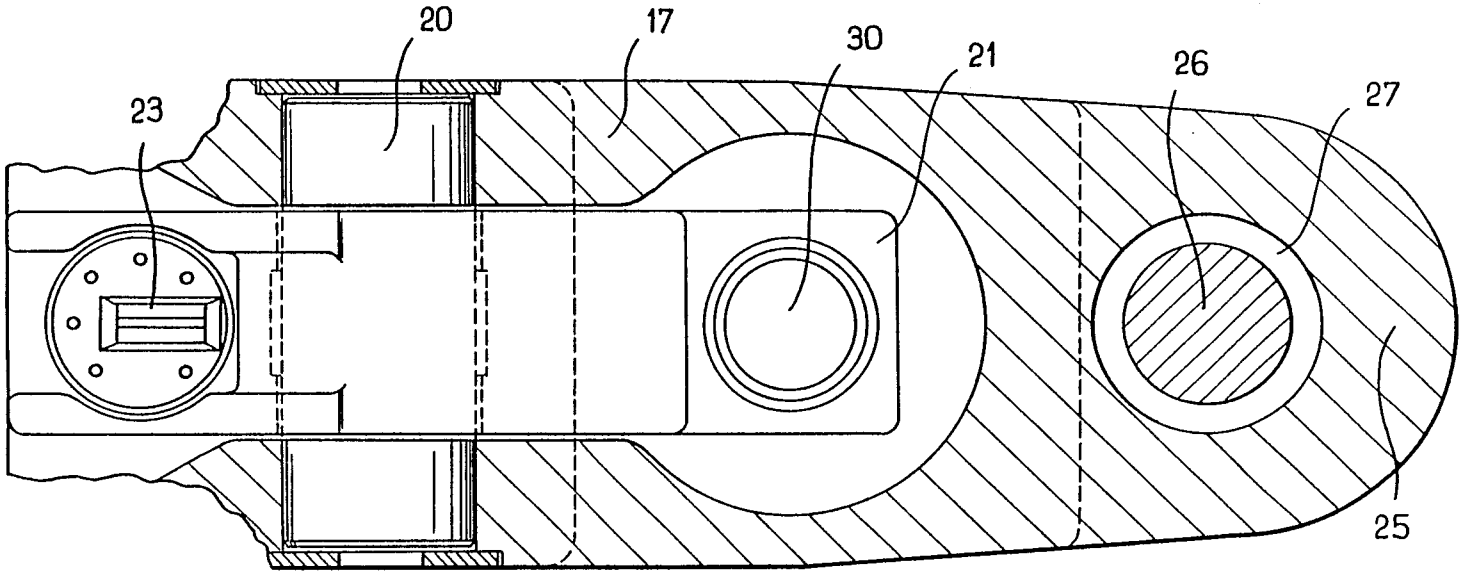
FIG. 6 is a longitudinal section along the line EE in FIG. 3.

The fixed jaw 17 comprises a longitudinal traversing recess 18 in which is set a mobile jaw 19 of elongated shape, articulated in a horizontal plane about a transverse axle 20 traversing and pivoting in the fixed jaw 17. The rear part 21 of the mobile jaw 19 is longer, relative to the axle 20, than the nose 22 of the said mobile jaw 19, so as to form a lever arm. An upper grip 23 is attached beneath the nose 22 of the mobile jaw 19. A lower grip 24 is attached opposite the upper grip 23, on the fixed jaw 17. As particularly seen in FIGS. 3 and 6, a tail 25 of fixed jaw 17 is shaped to fit into the fork 10, without touching it. A vertical axle 26 traversing the fork 10 and the tail 25 ensures the liaison between these two parts.

A universal ball-joint 27, seated between the axle 26 and the walls of a vertical traversing recess 28 provided in the tail 25, allows the fixed jaw 17, and therefore also the mobile jaw 19, to move freely in all directions.

A piston 29, seated in the fixed jaw 17, beneath the rear part 21 of the mobile jaw 29, by means of its shaft 30, and by thrust against the rear part 21, enables the upper grip 23 to be brought toward the lower grip 24, and thus to clamp the shaped bar 31 engaged between the upper grip 23 and lower grip 24. The disengagement of the shaped bar 31 from the upper grip 23 and lower grip 24 is effected by release of the pressure in the piston 29 and by thrust on the rear part 21, exerted for example by a return spring 32 or by an equivalent device set in the upper part of the fixed jaw 17, at a location as near as possible to the extremity of the rear part 21, and in any case, between the latter and the axle 20. On its front face 35, the fixed jaw is mounted in a rest 36 shown in FIGS. 3, 4 and 5, so as to be able to rotate. The rest 36 is seated on the carriage 3 by means of two laterally disposed vertical pistons 37 and 38. The pistons 37 and 38 ensure the balance and positional adjustment of the stretching head 1 in the vertical plane. A sleeve 39, located on the upper part of the stretching head 1, can be screwed transversely, with both left and right hand threads, on the one hand on a threaded shaft 40, integrally fixed to the rest 36 by means of a lug 41, and on the other hand, on a threaded shaft 40' integrally attached to the fixed jaw 17 by means of a lug 42 provided on the fixed jaw and a lug 43 provided on a ring 44 itself integrally fastened to the fixed jaw 17 by several means of attachment 45.

Figure 4:
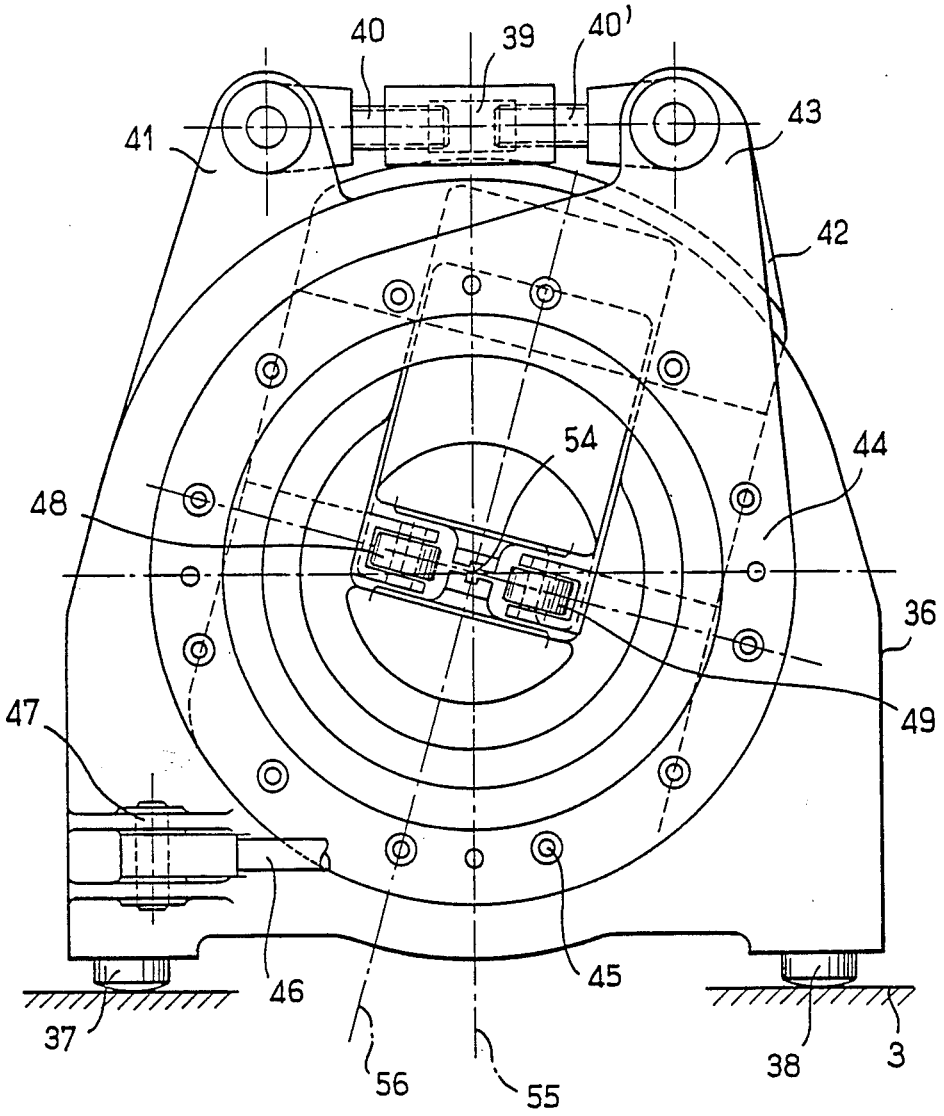
FIG. 4 is a view, along the arrow A of FIG. 3, of the front side of the fixed head shown in section in FIG. 3.
Figure 7:
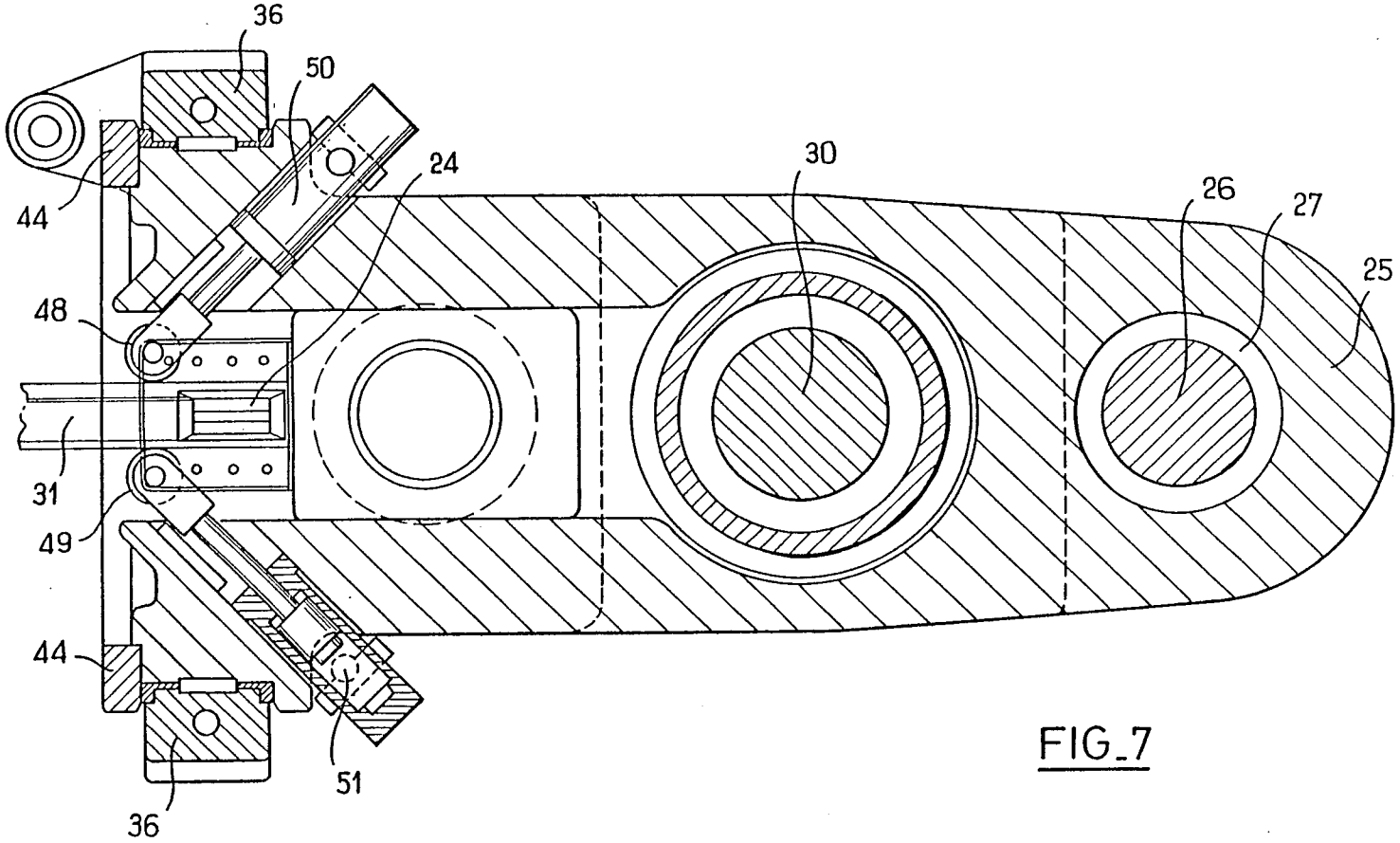
FIG. 7 is a longitudinal section along the line FF in FIG. 3.

A piston (not shown) attached, on the one hand, to the carriage 3, and on the other hand, by means of its shaft which is partially represented, to the tie 47 on the lower part of the rest, and which functions in the horizontal plane, ensures the lateral displacement of the stretching head 2. Rotary rollers 48 and 49, shown in FIGS. 4 and 7, are placed on the entrance face of the stretching head 1, on either side of the grips 23 and 24. The position of the rollers 48 and 49 can be adjusted by the pistons 50 and 51 or by equivalent systems.

MODE OF OPERATION

The machine functions in the following manner.

Figure 5:
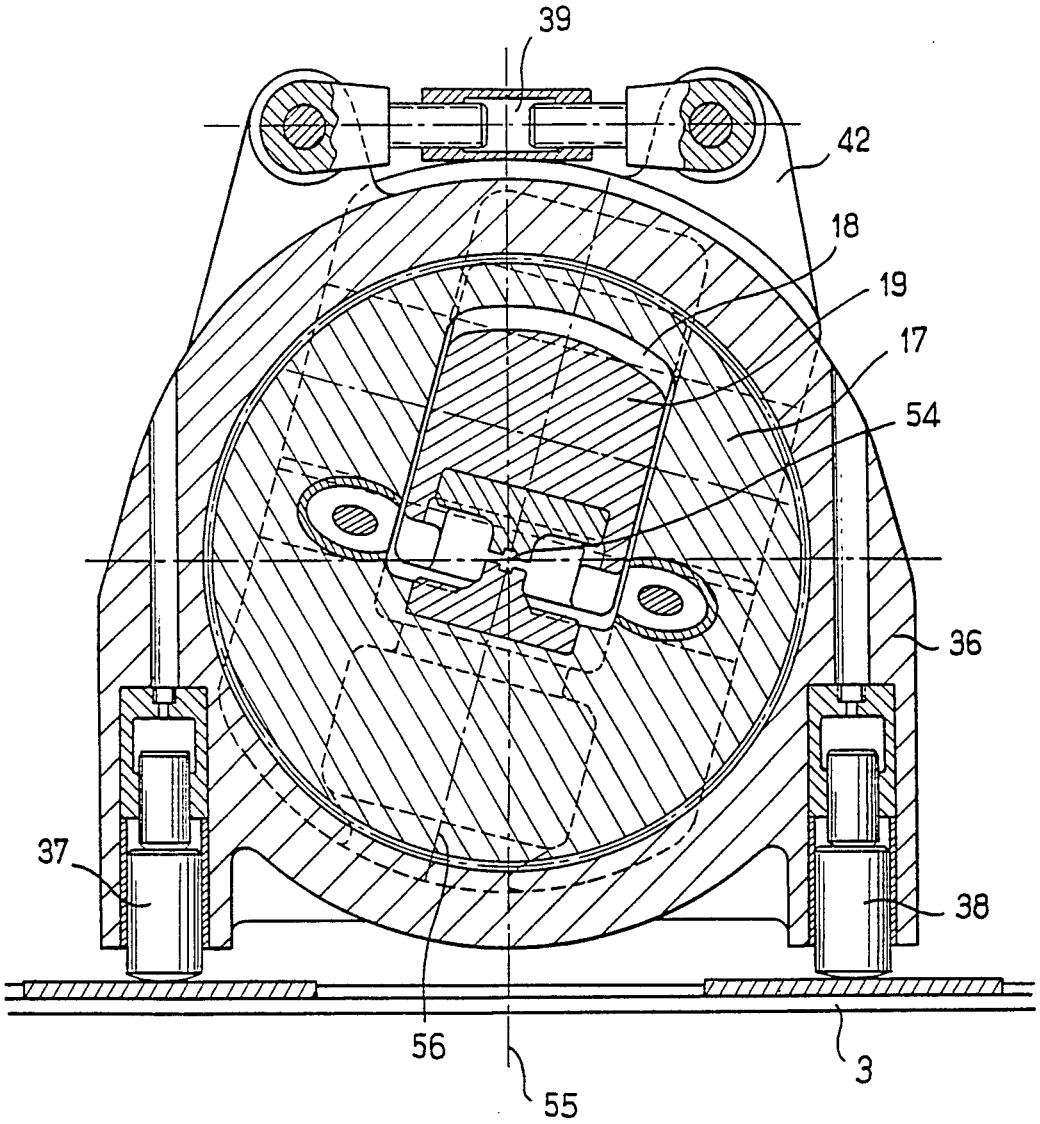
FIG. 5 is a transverse section along the line BB in FIG. 3.
Figure 8:
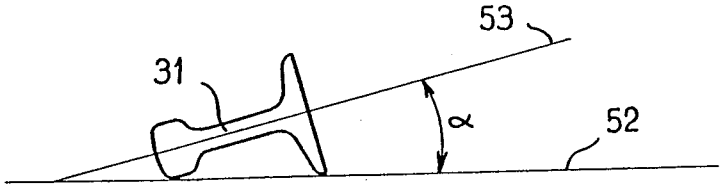
FIG. 8 shows the section of a rail, represented in the position in which it is introduced into the machine.
Figure 9:
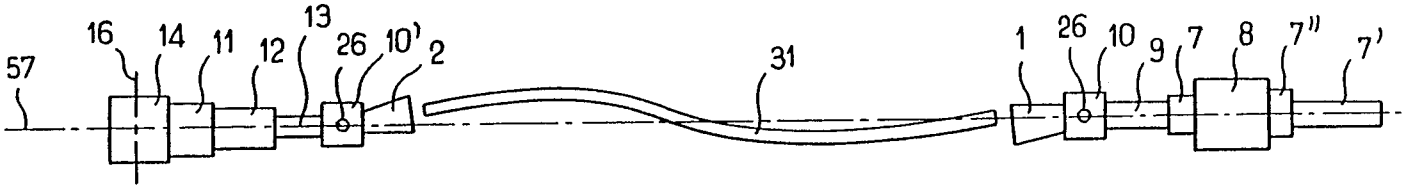
FIG. 9 is a schematic plan view of the machine according to the invention, showing the relative positions of the fixed and mobile heads and of the rail, before engaging the rail in the heads.

The rails 31 are fed into the machine and discharged by a handling system (not shown). They rest on the extremity of the flange with the side of the head in an "inclined" position, shown in FIG. 8, and are disposed between heads 1 and 2 in their as-cooled state, without being subjected to a prior deformation, as seen in FIG. 9, in order to avoid any damage to their internal structure. Before any stretching operation for a given rail profile, it is necessary to adjust the orientation of the fixed 17 and mobile 19 jaws and of the heads 1 and 2 so that they can receive the extremities of the rail to be straightened. This adjustment is made according to the angle $\alpha$ shown in FIG. 8, formed by the horizontal plane 52 in which the rail 31 rests and the plane of symmetry 53 of the rail. The adjustment is made by rotating the heads 1 and 2 within the rests 36 about a longitudinal axis 54, using the screwable sleeve 39, the threaded shafts 40 and 40' and the lugs 41 and 43 (or by an equivalent means), acting on the rings 44. This rotation is made about the axis 54 defined by the intersection of the median longitudinal plane 55 of the rest 36 and the median longitudinal plane 56 of the fixed 17 and mobile 19 jaws, as shown in FIG. 5.

The fixed 17 and mobile 19 jaws being thus prepared to receive the extremities of the rails 31, it remains to bring the heads 1 and 2 opposite and in alignment with the said extremities. This is done by lateral displacement of the heads 1 and 2, and using, as shown in FIG. 4, the pistons represented by their shafts 46, by sliding the front faces of the heads 1 and 2 on the extremities of the piston shafts 37 and 38 over the surfaces of the carriages 3.

Figure 10:
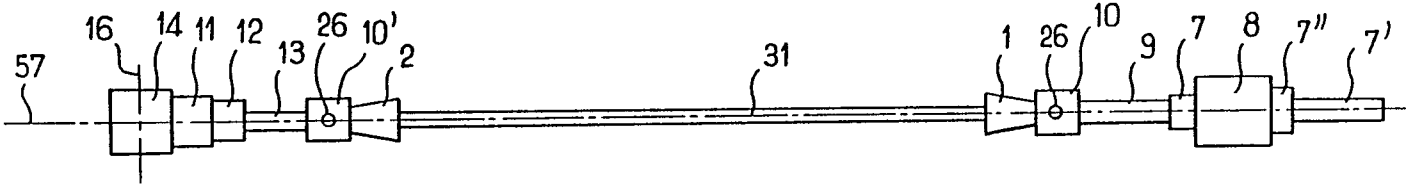
FIG. 10 is a similar view to that of FIG. 9, showing the respective positions of the fixed and mobile heads and of the rail, at the beginning of the stretching operation.

FIG. 9 shows schematically, seen from above, the respective positions of the rail 31 and of the heads at the end of this operation. FIG. 10 shows the same view at the beginning of stretching. The reference 57 designates the axis of the machine. The rail 31 of FIG. 9 is shown as it can occur in the as-cooled state, before straightening. As can be seen, its extremities, as well as the entire rail, are not in alignment with the axis 57 of the stretching machine. The heads 1 and 2 are brought opposite the extremities of the rail 31 by a combined displacement of the heads 1 and 2 and of the extremities of the rail, as indicated in FIG. 9. When this has been done, the heads 1 and 2 are advanced toward the rail 31 using the pistons 7 and 12, respectively. The introduction of the extremities of the rail 31 is facilitated by the rollers 48 and 49 which center it along the axis of the grips. Once the extremities are in place between the grips 23 and 24, shown in FIG. 3, the said grips are tightened with the aid of the pistons 30 and the heads 1 and 2 according to a predetermined and controlled force. A tensile force is next exerted by means of the piston 11 and the stretching head 2. The rail 31 and the heads 1 and 2 are then automatically aligned with the axis 57 of the machine, as indicated in FIG. 10, by virtue of the conception of the machine as previously described. From this stage onwards, the machine functions in a conventional manner according to a programmed stretching cycle.

We claim:

1. A stretching machine for straightening and stress-relieving steel rails, including a first longitudinal axis, a stretching head and a fixing head, each head being attached to a hydraulic command piston having an associated shaft and supported on a motorized carriage for displacement along the first longitudinal axis, each head including grip-carrying jaws, the hydraulic command piston of the stretching head being secured at one end of the machine to a frame by a cross head, the hydraulic command piston of the fixing head being secured at the other end of the machine to a frame by means of a cross head, the improvement comprising:

(a) a ball-joint coupling connecting the shaft of one hydraulic command piston to the stretching head for permitting the stretching head to move freely in all directions relative to the coupling;

(b) a ball-joint coupling connecting the shaft of the other hydraulic command piston to the fixing head for permitting the fixing head to move freely in all directions relative to the coupling;

(c) the stretching and fixing heads each include a fixed jaw carrying a lower grip, a mobile jaw carrying an upper grip, a hydraulic jaw piston including an associated shaft carried by the fixed jaw for moving the mobile jaw between open and closed positions relative to the fixed jaw, a return mechanism for disposing the mobile jaw in the open position when the hydraulic jaw position is deactivated, a transverse rest supporting the fixed jaw for rotation about a second longitudinal axis, a system linking the transverse rest to the fixed jaw, and a separating systme for rotating the fixed jaw about the second longitudinal axis; and (d) wherein the ball-joint couplings permit self-alignment of the heads and a rail disposed therebetween along the first longitudinal axis during initial stretching of the rail and further permit the rail to be stretched along the first longitudinal axis.

2. The stretching machine of claim 1 wherein:

(a) the fixed jaw is connected to the associated shaft of the hydraulic command piston by the ball-joint coupling;

(b) the mobile jaw is mounted for articulation in the fixed jaw by a horizontal transverse axle;

(c) the shaft of the hydraulic jaw piston engages the rear portion of the mobile jaw to cause the latter to swivel about the horizontal transverse axle;

(d) the return mechanism is disposed between the upper part of the mobile jaw and the fixed jaw;

(e) the transverse rest includes a pair of vertical pistons for supporting the rest on the surface of the carriage and permitting the balancing and adjustment of the rest in the vertical direction; and (f) guide rollers disposed ahead of and to either side of the upper and lower grips for facilitating the engagement of the extremities of the rail by the grips and the centering of the rail therebetween.

3. The stretching machine of claim 1 wherein the system linking the transverse rest to the fixed jaw includes:

(a) a ring carried on the front face of the fixed jaw and including a first eccentric lug;

(b) a second eccentric lug carried on the upper part of the fixed jaw opposite the first eccentric lug; and (c) a third eccentric lug disposed on the upper part of the transverse rest on the opposite side of the first and second eccentric lugs.

4. The stretching machine of claim 3 wherein the separating system includes one end fixed to the third eccentric lug and another end fixed to the first and second eccentric lugs.

* * * * *